United States Patent [19]

Landenberger et al.

[11] 3,996,324

[45] Dec. 7, 1976

[54] PROCESS FOR PRODUCING ORIENTED CONTINUOUS YARNS

[75] Inventors: Peter Landenberger, Hanau; Heinz Schuttrichkeit; Georg Treutel, both of Kelsterbach, all of Germany

[73] Assignee: Metallgesellschaft Aktiengesellschaft, Frankfurt am Main, Germany

[22] Filed: July 30, 1974

[21] Appl. No.: 493,204

[30] Foreign Application Priority Data

Sept. 22, 1973 Germany ..... 2347801

[52] U.S. Cl. ..... 264/103; 264/130; 264/210 F

[51] Int. Cl.[2] ..... D02G 1/20

[58] Field of Search ..... 264/210 F, 103, 130; 57/164, 157 R

[56] References Cited

UNITED STATES PATENTS

| | | | |
|---|---|---|---|
| 3,339,357 | 9/1967 | Marzocchi et al. | 57/164 |
| 3,423,809 | 1/1969 | Schmitt | 264/103 |
| 3,457,338 | 7/1969 | Lefevre | 264/210 F |
| 3,486,318 | 12/1969 | Cannon et al. | 264/103 |
| 3,505,803 | 4/1970 | Hughey | 264/103 |
| 3,558,757 | 1/1971 | Denyes et al. | 264/103 |
| 3,604,659 | 9/1971 | Jueggli et al. | 57/157 S |
| 3,681,910 | 8/1972 | Reese | 264/103 |
| 3,707,593 | 12/1972 | Fukada et al. | 264/210 F |
| 3,752,457 | 8/1973 | Parmeggiani et al. | 264/210 F |
| 3,840,630 | 10/1974 | Yamata et al. | 264/103 |

FOREIGN PATENTS OR APPLICATIONS

| | | | |
|---|---|---|---|
| 46-412 | 1/1970 | Japan | 264/210 F |
| 46-3809 | 1/1971 | Japan | 264/210 F |
| 43-19612 | 8/1968 | Japan | 264/210 F |
| 44-16173 | 7/1969 | Japan | 264/210 F |
| 934,519 | 8/1963 | United Kingdom | 264/103 |
| 1,142,920 | 2/1969 | United Kingdom | 264/103 |

*Primary Examiner*—Jay H. Woo
*Attorney, Agent, or Firm*—Burgess, Dinklage & Sprung

[57] ABSTRACT

Oriented continuous yarns are produced from synthetic thermoplastic by melt-spinning monofilaments which are taken off, cooled and wound up without the use of a godet roll at velocities of more than 2500 meters per minute. The monofilaments are combined in a bundle after the cooling zone which is then toted and moved through at least one vertically adjustable guide before it is wound up.

4 Claims, 6 Drawing Figures

A
N
α

PROCESS FOR PRODUCING ORIENTED CONTINUOUS YARNS

BACKGROUND

This invention relates to a process of producing pre-oriented continuous yarns from synthetic thermoplastics by a melt-spinning of monofilaments, which are subsequently taken off, cooled and wound up without use of a godet roll and at velocities of more than 2500 meters per minute.

Spinning processes are known in which godet rolls rotating virtually at the take-off velocity are used as deflecting means. In the spin-stretching process, the filament is stretched in a hot or cold condition between two godet rolls or two pairs of godet rolls and at take-off velocities up to about 4000 meters per minute. The use of godet rolls results in frequent trouble during operation so that the spinning process is interrupted and production is lost. Where hot godet rolls are used, they must be heated to relatively high temperatures so that additional costs are incurred.

High-speed spinning processes obviously involve higher requirements as regards the precision of the means which participate in the formation of the yarn and as regards the process conditions.

The resulting yarns should have uniform good physical properties and should be such as to enable a further processing with a minimum of trouble. This will particularly depend on the compacting properties of the filaments, on the formation of a uniform coating balanced moisture absorption and desorption, the formation of a uniform package without floofs and loops, etc.

SUMMARY

It is an object of the invention to provide particularly suitable processes which enable a simple production of yarns having improved properties for their further processing and at take-off speeds of more than 2500 meters per minute.

According to the invention, the monofilaments are combined in a bundle after the colling zone, and the bundle is coated and is moved through at least one adjustable guide before it is taken up. It has been found that it is important for the quality of the yarn and for its further processing that the monofilaments of the yarn are uniformly coated. Particularly at the high take-off and wind up velocities above 2500 meters per minute, preferably in the range of 3000–6000 meters per minute, a uniform coating of the filaments is very difficult. This object can be accomplished in a simple manner by means of the adjustable guide, which also controls the yarn tension, which is significant for the coating step and for the subsequent take-up. ,

DESCRIPTION

Figures 1, 2, 3, 4, 5, 6:
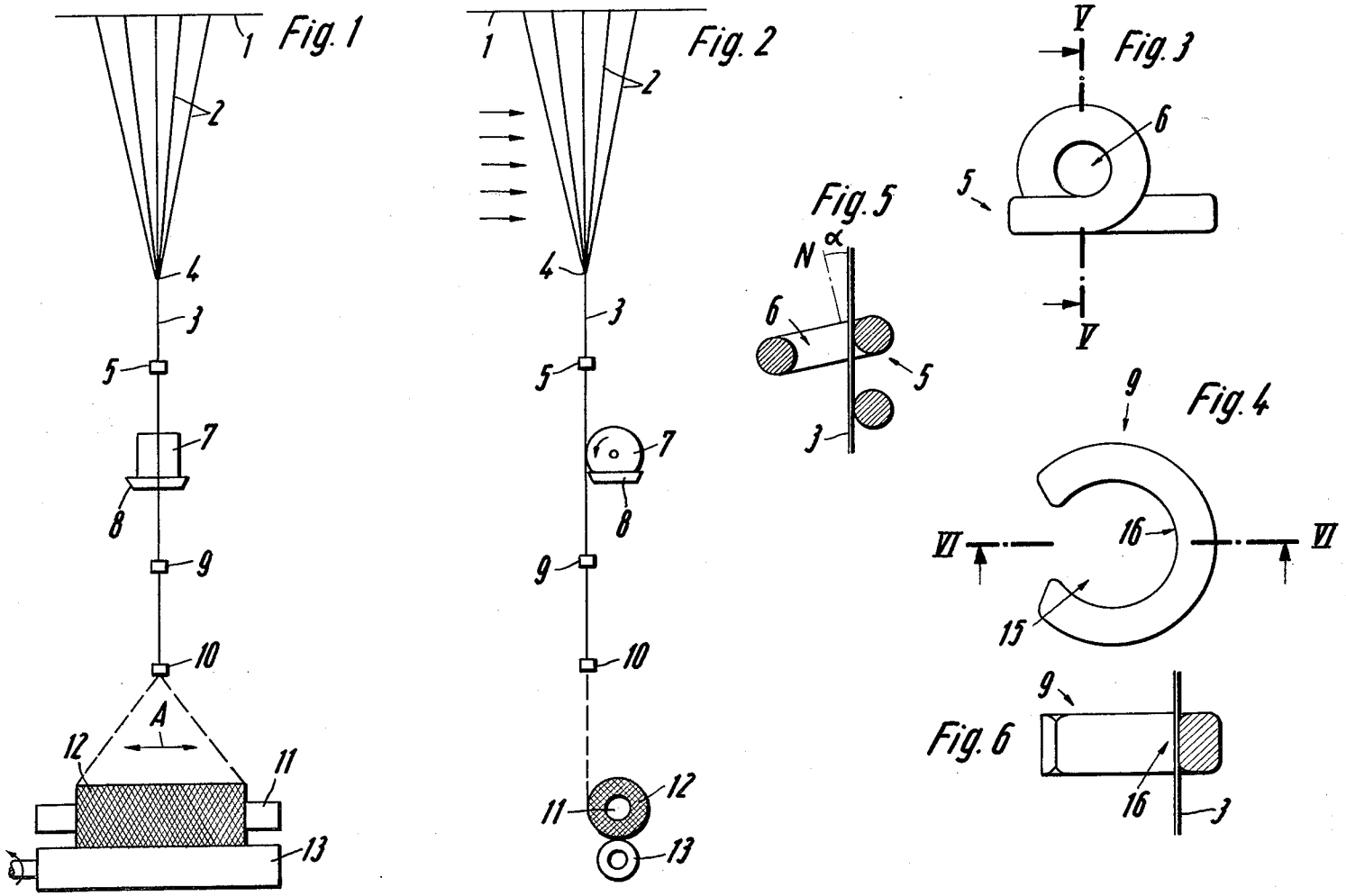
FIG. 1 is a schematic view of apparatus suitable for carrying at the process for producing pre-oriented yarn.
FIG. 2 is a side view of the apparatus of FIG. 1.
FIG. 3 is a top plan view of a yarn guide.
FIG. 4 is a top plan view of a horseshoe-shaped yarn guide.
FIG. 5 is a sectional view taken along line V-V of FIG. 3.
FIG. 6 a sectional view taken along line VI-VI of FIG. 4.

Between the cooling zone and the coating zone the filament bundle is preferably combined by a guide, which is disposed in this area and which imparts a twist to the monofilaments. In this case the filaments coact with a guide before then are coated. It has been found that the filaments can be combined in a bundle as proposed by means of yarn guide consisting of a ceramic oxide. The resulting filament bundle has an improved contact with the subsequent coating means, usually a coating roller, and is uniformly coated thereby as desired. In a special embodiment of the process, the guide may be disposed adjacent to the cooling zone.

The adjustment of a correct yarn tension is significant for the coating step. In the present process the distance from the yarn guide to the point where the filaments coming from the spinning and cooling means merge to form a bundle is significant. The yarn tension is variable by the adjustment of the yarn guide or guides, and a higher yarn tension will be indicated by a larger distance between the spinneret and the bundling point.

The process results in yarns which have excellent properties for the further processing. It may be used to make melt-spun yarns, e.g., of polyamide, polyester, polyolefins or other polymers. A very simple technology permits of relatively large outputs and results in yarns which have been stretched to a high degree and possess a residual elongation down to about 50%. The final yarn distinguishes, inter alia, by a particularly good dye affinity and durability in storage.

The process will now be explained more fully with reference to the drawing, which illustrates an embodiment by way of example.

A large number of filaments 2 are spun by the spinning device 1 and combined in a filament bundle 3. Below the spinning device, the filaments 2 move through a cooling zone in which blown air causes them to harden.

The combination of the filaments 2 in a filament bundle 3 is mainly due to the action of a first yarn guide 5. A preferred embodiment of said yarn guide is shown in an enlarged view in FIG. 3. The filament bundle travels through the eyelet 6 of said yarn guide and further below contacts the surface of a coating roller. The latter rotates in the direction of travel of the filaments and from a trough 8 carries the liquid coating material to the top surface of the roller and to the the filament bundle. The coating material consists, e.g., of oil-water emulsions.

Below the roller 7, the yarn travels through a secound yarn guide 9, which controls the contact pressure of the yarn on the roller 7 and the distribution of the monofilaments of the bundle 3 over the surface of the roller. A suitable horseshoe-shaped filament guide 9 is shown in FIG. 4.

The yarn wind-up device is disposed below the yarn guide 9 and is indicated only by its essential parts. These incldude an adjustable stationary guiding eyelet 10, below which the yarn is moved forth and back by a traversing device, which is not shown and indicated by the double arrow A. The guiding eyelet 10 forms the apex of the so-called traversing triangle. The yarn is taken up on a bobbin 11 to form a yarn package 12. The bobbin is driven by a drive roller 13, which engages the package and which is driven by an electric motor, not shown. The yarn is taken off and taken up at velocities of 3000–6000 meters per minute, preferably of 3500–4000 meters per minute.

The two yarn guides 5 and 9 are of great importance for the application to the yarn of a coating which is as uniform as possible by means of the roller 7. It has been found that the yarn guide 5 has suitably the form shown in FIGS. 3 and 5, which is known as a pigtail guide in the art. The filament guide is made, e.g., of a ceramic oxide and has a guiding eyelet 6, which has portions that surround the yarn and are convexly curved toward the yarn. See also FIG. 5. The pigtail-shaped yarn guide prevents the yarn from jumping out of the guide at the beginning of the spinning operation. The yarn guide is secured to a holder, not shown, and can be fixed by said holder in any desired position. In use, the yarn guide is adjusted to such a position, as shown in FIG. 5, that the filament bundle 3 slides along the eyelet 6 at an acute angle $\alpha$ to the normal N on the eyelet 6; said acute angle is generally smaller than 40°. The normal is at right angles to the plane of FIG. 3. With that adjustment, those portions of the convex sliding surfaces of the eyelet 6 which contact the filaments 2 impart a twist to the latter so that the filament bundle 3 is twisted as desired and the filament bundle 3 is held compactly together even above the yarn guide 5.

To ensure an optimum coating of the filament bundle 3 on the roller 7, the filaments 2 should move over the surface of the roller 7 like a strip along closely spaced, parallel paths, so far as possible, rather than along helical paths. To that end, the previously twisted bundle 3 must be parallelized, and the yarn guide 9 (FIGS. 4 and 6) is provided for that purpose. The yarn guide 9 forms an open eyelet 15, which is convexly curved toward the axis of the yarn (FIG. 6). The angle between the sliding surface 16 of the yarn guide 9 and the yarn 3 in sliding contact therewith is selected in the manner which has been basically described in conjunction with the yarn guide 5 so that the filaments are subjected to a twisting action which opposes the twist imparted by the yarn guide 5 and the filaments are thus slightly separated between the two yarn guides and contact the roller 7 in the desired strip pattern. The yarn guide 9 may also be adjusted to any desired position.

The yarn guides are responsible not only for the arrangement of the filaments in the filament bundle 3 but also for the adjustment of the correct yarn tension. In use the desired yarn tension is checked by an inspection of the point 4 where the filaments merge. If the twist imparted to the filaments particularly by the yarn guide 5 and also by the yarn guide 9 is increased, the point 4 will move up-wardly toward the spinning device 1. As a result, the drag of the filament bundle is decreased and with it the yarn tension. A person skilled in the art can easily maintain the desired yarn tension during the operation of a spinning plant according to the invention if he is aware of this relationship.

EXAMPLE 1

A polyethylene terephthalate polyester having a relative viscosity of 1.64 is melt-spun at a rate of 92 grams per minute through a spinneret having 32 orifices. The filament bundle leaving the spinneret is taken off by means of a take-up head at a velocity of 3500 meters per minute. Below the spinneret, the filament bundle is cooled by blowing with air in a cooling zone having a length of 1.40 meters and then enters a vertical shaft having a length of 3 meters. A coating device consisting of a roller 7 and a trough 8 is disposed below that shaft. The filament bundle 3 is tangentially moved past the coating roller and is moved through an adjustable yarn guide 9, which is adjusted to such an angular position that the twist imparted by the guide corresponds to a yarn tension of 55 grams. The filament bundle has a denier of 240 and is taken up in the usual manner.

EXAMPLE 2

Polyamide-6 is melt-spun at a rate of 43 grams per minute through a spinneret having 32 orifices. The filament bundle 3 leaving the spinneret is taken off at a velocity of 3600 meters per minute. As in Example 1, the bundle is air-cooled in a cooling zone below the spinneret and is then moved through a vertical shaft having a length of 3 meters. After leaving the vertical shaft, the filament bundle is moved first through a yarn guide 5 and then tangentially past the coating roller 7. Through an adjustable yarn guide 9, the yarn proceeds to the apex of the traversing triangle of the take-off device. The two yarn guides 5 and 9 are adjusted to angular positions corresponding to a yarn tension of 35 grams. The filament bundle having a denier of 106 is taken up in known manner.

What is claimed is:

1. A high speed single step process for producing pre-oriented synthetic yarn comprising melt spinning a plurality of synthetic thermoplastic filaments, cooling the filaments with a cooling gas, merging said filaments into a twisted bundle, sliding said bundle through a pigtail guide which is cocked at an angle, the angle between the yarn direction and the axis of the guide being less than 40° but sufficient so that the bundle actually slides along the guide, said sliding contact producing twist upstream of said pigtail guide so that there is a compact bundle immediately upstream of said pigtail guide, passing said yarn to a horseshoe guide which twists the bundle in opposite direction from the pigtail guide so as to produce an untwisted yarn in ribbon form between the pigtail and horseshoe guides, lubricating the ribbon of filaments between said guides, and downstream of said horseshoe guide for the first time contacting said yarn with an advancing roll, said roll taking up the yarn at a speed of from 2500 to 6000 meters per minute.

2. Process of claim 1 wherein tension on the filament bundle is proportional to the distance from melt spinning to the point where the filaments merge to form said bundle and is adjusted with reference to that distance.

3. Process of claim 1 wherein the twisting action of the first and second guides is varied by adjusting the sliding surfaces of said guides relative to the direction of travel of the filament bundle.

4. Process of claim 1 wherein the advancing roll is a takeup roll.

* * * * *